US006378710B1

(12) United States Patent
Grueneberg

(10) Patent No.: US 6,378,710 B1
(45) Date of Patent: Apr. 30, 2002

(54) ADJUSTABLE SHELF UNIT

(75) Inventor: Bevan E. Grueneberg, Cedarburg, WI (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 09/592,332

(22) Filed: Jun. 13, 2000

Related U.S. Application Data

(60) Provisional application No. 60/139,009, filed on Jun. 14, 1999.

(51) Int. Cl.[7] ..... A47F 3/14

(52) U.S. Cl. ..... 211/132.1; 211/72

(58) Field of Search ..... 211/133.1, 149, 211/132.1, 135, 128.1, 72, 126.16; 248/174, 152; 108/107, 165, 162, 106, 147.11, 144.11; 312/242, 245

(56) References Cited

U.S. PATENT DOCUMENTS 1,886,532 A * 11/1932 Davidson
2,135,093 A * 11/1938 Abrams
2,316,892 A * 4/1943 Saul, Sr.
2,356,473 A * 8/1944 Saul, Sr.
2,579,704 A * 12/1951 Saul, Sr.
3,508,734 A * 4/1970 Thomas
4,086,858 A * 5/1978 Howitt ..... 211/153
4,153,311 A * 5/1979 Takahashi ..... 211/186
4,164,287 A * 8/1979 Muller et al. ..... 211/134
4,373,449 A * 2/1983 Klaus et al. ..... 248/174
4,530,548 A * 7/1985 Spamer et al. ..... 211/189
4,562,776 A * 1/1986 Miranda ..... 108/111
4,760,928 A * 8/1988 Bustos ..... 211/150
4,813,553 A * 3/1989 Franklin et al. ..... 211/133
5,000,329 A * 3/1991 Luberto ..... 211/133
5,253,769 A * 10/1993 Vlastakis ..... 211/132
5,318,190 A * 6/1994 Mason ..... 211/175
5,392,902 A * 2/1995 Vlastakis ..... 206/45
5,443,168 A * 8/1995 Dyment et al. ..... 211/186
5,513,745 A * 5/1996 Zoltan et al. ..... 206/764
5,632,390 A * 5/1997 Podergois ..... 211/195
5,974,707 A * 11/1999 Kowalczyk ..... 211/186
6,068,140 A * 5/2000 Mangrum et al. ..... 211/132.1
6,126,254 A * 10/2000 Maglione ..... 248/174

* cited by examiner

*Primary Examiner*—Jerry Redman
*Assistant Examiner*—Jennifer E. Novosad
(74) *Attorney, Agent, or Firm*—Quarles & Brady LLP

(57) ABSTRACT

An adjustable shelving unit has a shelf support to which can be mounted one or more shelves. The shelf support has a slotted back panel and edge walls with laterally aligned notches. The shelf support fits through an opening between the bottom and a back cross-member of each shelf. Each shelf bottom has transverse openings in its back corners to accommodate the shelf support edge walls so that the shelf bottom engages the notches in the shelf support edge walls. The shelves are secured to the shelf support by engagement with the notches as well as by one or more tabs at the bottom of the shelf which fit into slots in the shelf support. The notches have upwardly canted upper surfaces allowing each shelf to be pulled outward and rotated upward to disengage the shelf from the shelf support so that it may then be removed or positioned to a different height. The shelves and shelf support are constructed by folding separate corrugated paperboard blanks.

16 Claims, 6 Drawing Sheets

ADJUSTABLE SHELF UNIT

CROSS-REFERENCE TO RELATED APPLICATION

This application claims the benefit of U.S. provisional application serial No. 60/139,009 filed Jun. 14, 1999.

STATEMENT REGARDING GOVERNMENT SPONSORED RESEARCH OR DEVELOPMENT

Not Applicable.

BACKGROUND OF THE INVENTION

1. Field of the Invention

This invention relates to shelving, and in particular to foldable shelving which is primarily used for display or storage, for example in a retail store.

2. Discussion of the Prior Art

Shelf units made from corrugated paperboard or plastic material are known and have been made in various forms. Such units either have fixed shelves, meaning that the distance between shelves is not adjustable, or shelves in which the distance between them is adjustable. However, when the shelves are adjustable, a third piece, apart from the shelf and shelf support, was often required to connect the shelf to the shelf support in an adjustable manner.

The present invention is aimed at providing an adjustable shelf unit adapted to be made of corrugated paperboard and in which the shelves are easily assembled to the shelf support and adjusted relative thereto, without any additional pieces connecting the shelves to the shelf support.

BRIEF SUMMARY OF THE INVENTION

The present invention provides a shelving unit having a shelf support and a shelf that can be easily attached, adjusted and removed without additional connecting pieces.

Specifically, the shelf support has parallel edge walls extending from lateral edges of a back panel to a front edge. Each edge wall has a plurality of notches spaced apart along the front edge that are aligned laterally with the notches in the other edge wall. The shelf has side walls outside the edge walls joined along a bottom edge by a bottom panel. The bottom panel has slots adjacent the side walls that extend forward from a back edge less than the distance of the edge walls. The slots receive the edge walls such that a portion of the bottom panel fits within a row of notches in the edge walls. The side walls are also joined at an upper back side by a back cross-member outside the back panel. The back cross-member and the bottom panel define a lateral opening therebetween sized to receive the shelf support when the edge walls are disposed within the slots in the shelf bottom. Pulling the shelf from the front side away from the shelf support and pivoting the shelf upwardly releases the bottom panel from the notches so that the shelf may be removed from the shelf support or adjusted to a different height.

In addition to, or instead of, the notches in the edge walls, the back panel of the shelf support may include a column of slots longitudinally spaced apart and laterally aligned with the notches in the edge walls. In this case, the shelf can include a tab projecting back from the rear edge of the bottom panel that fits within a slot in the shelf support. The shelf support back panel can include a plurality of such columns of slots laterally aligned with the notches of the shelf support and the shelf can include a plurality of tabs aligned with the columns of slots.

The shelf and shelf support are each preferably constructed by folding respective shelf and shelf support blanks. The blanks are pre-cut and scored or perforated to make the folding process simple and efficient. The blanks are designed to form double or triple plies where needed for added structural support, so that the shelving unit can support more and heavier articles.

The shelf support back panel also may include at least one hanger opening for hanging the shelving unit. The opening can be a single hinged cut-out at the lateral center of the shelf support. A grip cut-out can also be positioned adjacent the hinged cut-out for opening the hinged cut-out.

Thus, the present invention provides a low-cost, sturdy shelving unit having shelves that can be connected and disconnected to the shelf support without the need for separate connectors or fasteners. The adjustable shelving unit can be constructed by folding flat blanks, preferably made of corrugated paperboard, so that numerous units can be compactly shipped prior to assembly. The shelving unit can be easily assembled by folding the pre-cut blanks at perforated or scored fold lines.

The foregoing and other advantages of the invention will appear from the following description. In this description reference is made to the accompanying drawings which form a part hereof and in which there is shown by way of illustration preferred embodiments of the invention. These embodiments do not represent the full scope of the invention. Thus, the claims should be looked to in order to judge the scope of the invention.

DETAILED DESCRIPTION OF THE PREFERRED EMBODIMENTS

Figure 1:
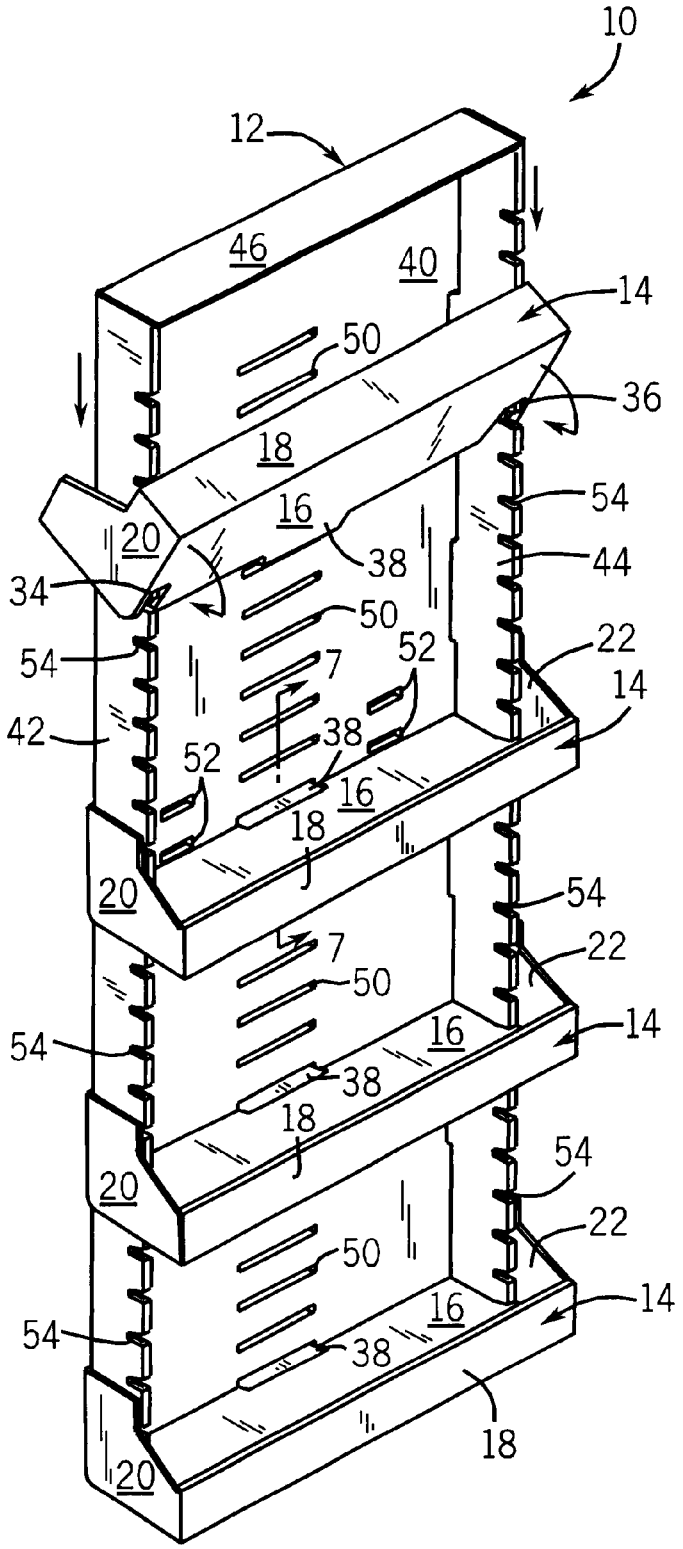
FIG. 1 is a front perspective view of an adjustable shelf unit of the invention, illustrating four shelves with one disengaged from the shelf support.
Figure 2:
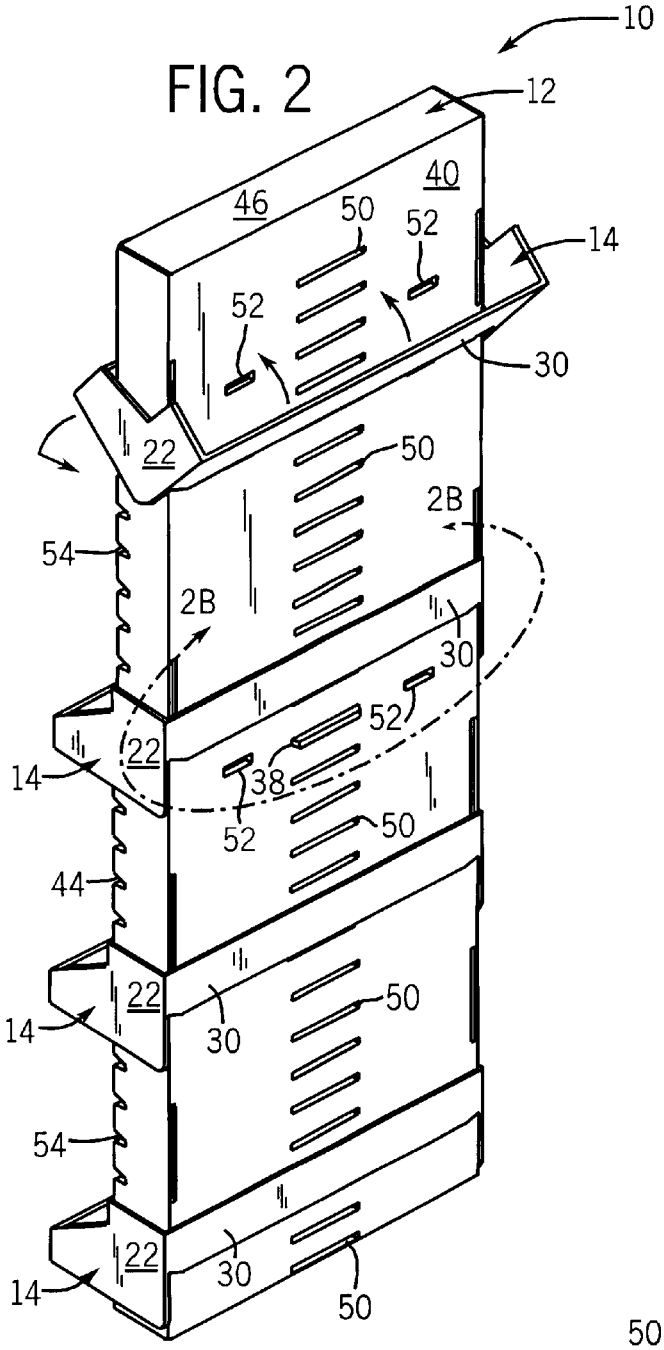
FIG. 2 is a rear perspective view of the adjustable shelf unit of FIG. 1.
Figure 3:
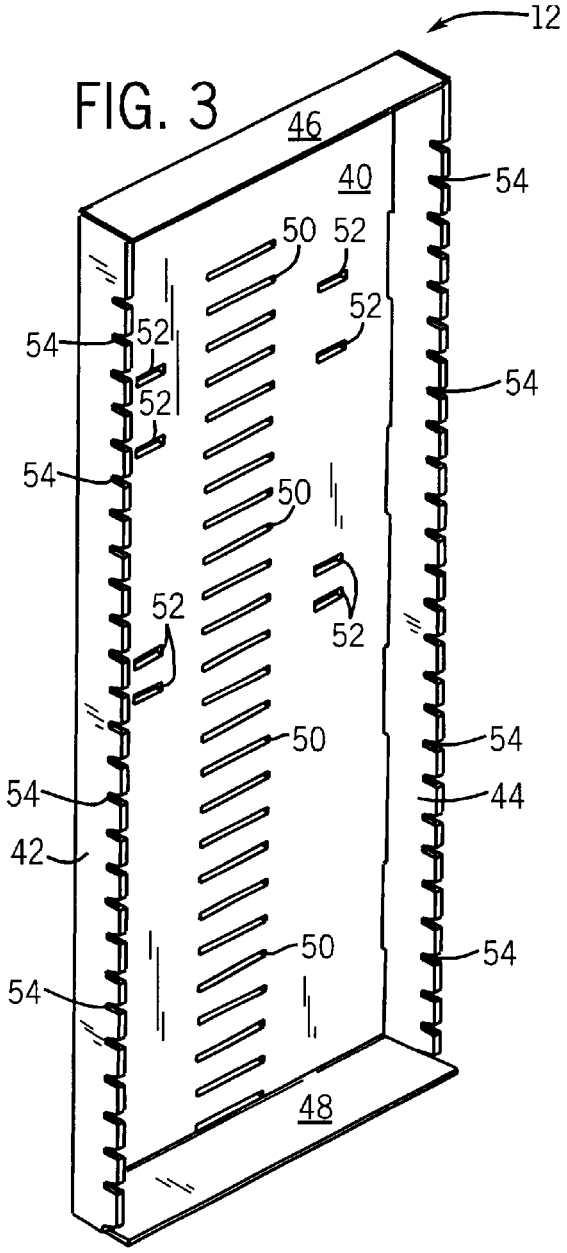
FIG. 3 is a front perspective view of the shelf support alone.
Figure 4:
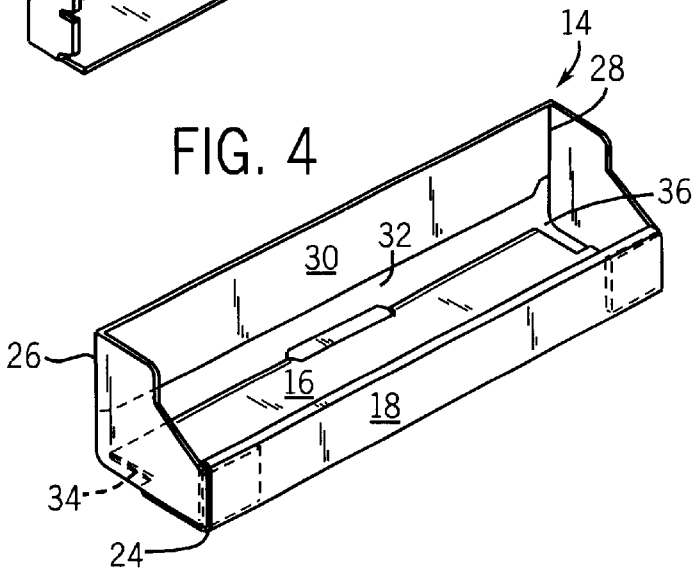
FIG. 4 is a front perspective view of the shelf alone.
Figure 5:
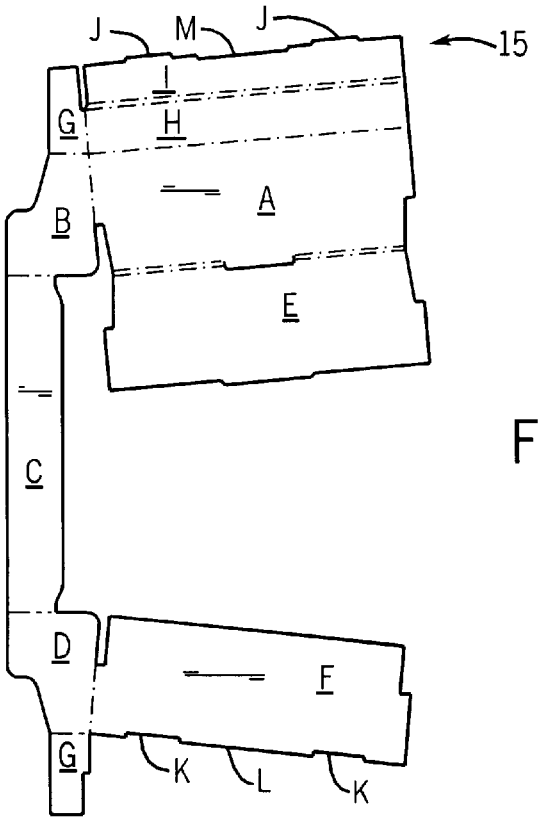
FIG. 5 is a plan view of a blank for making the shelf.
Figure 6:
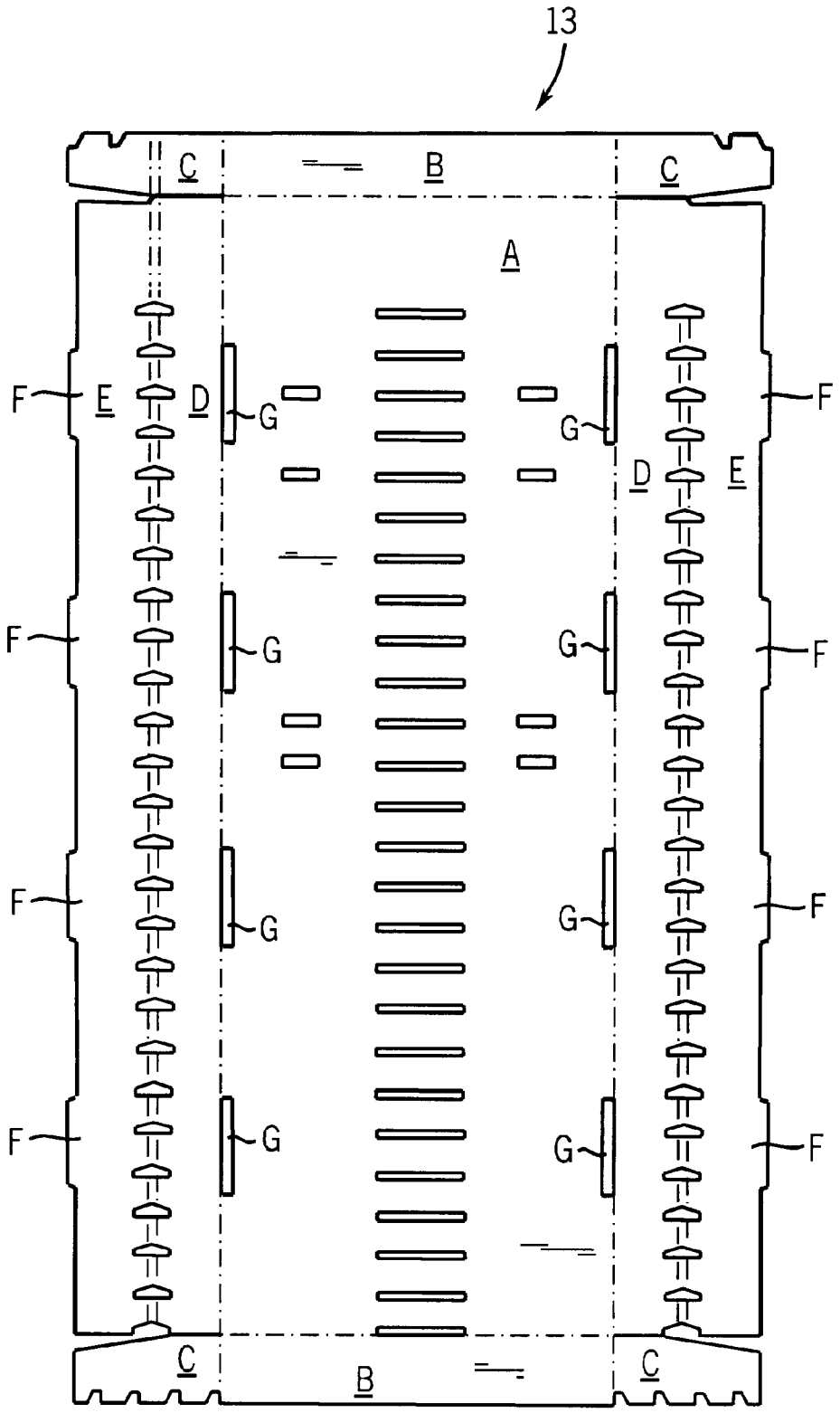
FIG. 6 is a plan view of a blank for making the shelf support.

An adjustable shelf unit 10 of the invention as shown in FIGS. 1 and 2 is made from two separate pieces: a shelf support 12 as shown in FIG. 3, made from a blank 13 shown in FIG. 6, and a shelf 14 as shown in FIG. 4, made from a blank 15 shown in FIG. 5. Both pieces may be made of 200 B-flute corrugated paperboard, with the corrugations running in the directions indicated by the phantom lines in FIGS. 5 and 6. However, the blanks 13 and 15 may be the same or different weight paperboard as well as the same or different sized corrugated plastic as known in the art. It may also be possible to make the shelf unit 10 out of other materials, such as metal, solid plastic, etc.

Referring now to FIG. 5, the shelf 14 is folded from the blank 15 by following these steps:

1. Fold panel D up 90° relative to panel C;
2. Fold panel C up 90° relative to panel B;
3. Fold panel E up 90° relative to panel A;
4. Fold side wall B up 90° relative to panel A. This positions panel F over panel A with panel E inside of panel C;
5. Fold panel E down over panel F;
6. Fold flaps G inward;
7. Fold panel H up 90°;
8. Fold panel I down over flaps G and engage tabs J in notches K, and tab L in notch M.

Referring to FIG. 4, in this way each shelf 14 includes a three-ply bottom 16 comprised of panels A, F and E (see FIG. 5) joined to a two-ply front wall 18. spanning between taller, single-ply side walls 20 and 22 at a front side 24. The side walls 20 and 22 are angled to allow access within each shelf 14 from the side. The top 28 of the side walls 20 and 22 are joined at a back side 26 by a single-ply cross-member 30. The cross-member 30 does not extend to the bottom 16, but rather is separated therefrom by a lateral opening 32. The bottom 16 has transverse slots 34 and 36 at back corners adjacent the side walls 20 and 22 as well as a single-ply lateral tab 38 projecting outward from the back side 26 at the lateral center of each shelf 14. The double and triple plies of the various components of the shelf 14 provide structural integrity for supporting displayed or stored articles.

Referring now to FIG. 6, the shelf support 12 is folded from the blank 13 by following these steps:

1. Fold flaps B up at 90° relative to panel A;
2. Fold flaps C inward 90°. Top flaps C have one set of notches which corresponds with the top set of notches in panels D–E, and the bottom flaps C have four sets of notches which correspond to the bottom four notches in the panels D–E;
3. Fold panels D up at 90° to panel A;
4. Fold panels E down 180° over flaps C and engage tabs F in slots G.

Referring to FIG. 3, in this way the shelf support 12 is constructed to have a single-ply back panel 40 with double-ply edge walls 42 and 44 made of panels D and E (see FIG. 6) as well as single-ply top 46 and bottom ends 48 at its perimeter. The back panel 40 has a column of slots 50 at its lateral center that are longitudinally spaced apart as well as four pairs of laterally spaced hanger openings 52 at various longitudinal locations for hanging the shelving unit 10 by a suitable hanger, hook or fastener. The edge walls 42 and 44 have notches 54 at their front edges that are aligned laterally with the slots 50. The notches 54 have upwardly canted top surfaces 56 (see FIG. 7). The bottom end 48 acts as the bottom surfaces of the bottom-most notches 54.

Figure 2B:
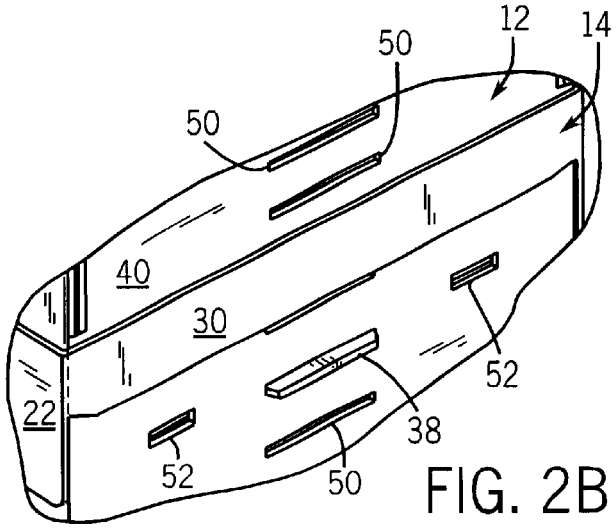
FIG. 2B is an enlarged rear view of the attachment of a shelf to the shelf support taken along line 2B—2B of FIG. 2.
Figure 7:
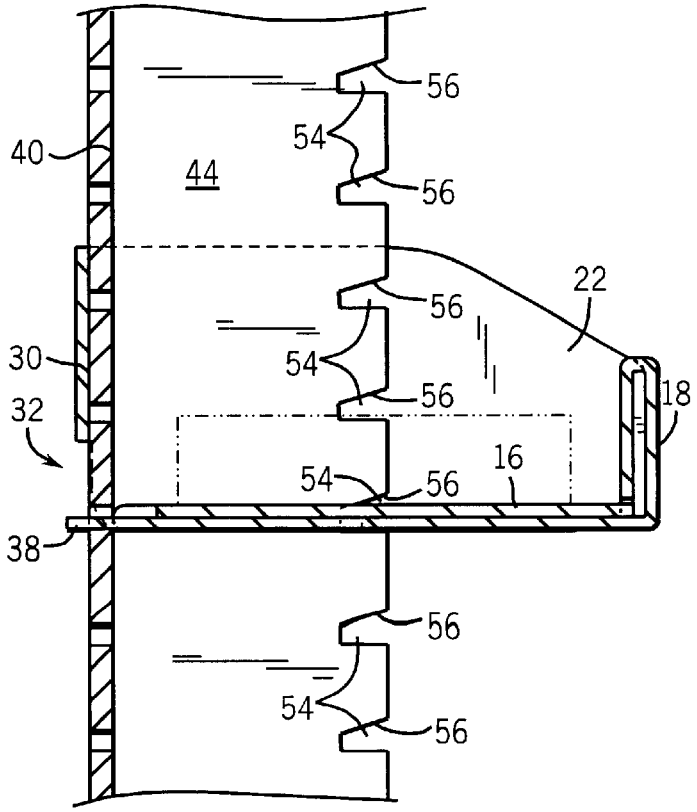
FIG. 7 is a side cross-sectional view taken along line 7—7 of FIG. 1, showing a shelf attached to the shelf support.

A shelf 14 is assembled to the shelf support 12 as shown in FIGS. 1 and 2. As best shown in FIG. 1, the transverse slots 34 and 36 in the bottom 16 of the shelf 14 receive the shelf support edge walls 42 and 44, respectively. The length of the transverse slots 34 and 36 is less than the depth of the edge walls 42 and 44 but long enough so that when the shelf 14 is tipped back as indicated in FIG. 1, the front of the transverse slots 32 and 34 clear the notches 54 in the front edges of the edge walls 42 and 44 of the shelf support 12. In this tipped back position, the shelf 14 can be slid over the top of the shelf support 12. With the shelf support 12 in the aforementioned opening 32 and transverse slots 34 and 36 of the shelf 14, the shelf 14 may be slid to the desired vertical position. Referring to FIGS. 2, 2B and 7, pushing the shelf 14 down and in seats the bottom 16 in a pair of notches 54 and the projecting tab 38 into the corresponding lateral slot 50 of the shelf support 12.

When the shelf 14 is loaded, the front of the shelf 14 will tend to tip down, pivoting about an axis through the notches 54 that are engaged with opposite side walls 20 and 24 of the shelf 14. However, the back cross-member 30 prevents the shelf 14 from tipping down. Thereby, a strong, inexpensive, easy to assemble and versatile adjustable shelf unit is provided.

Figure 8:
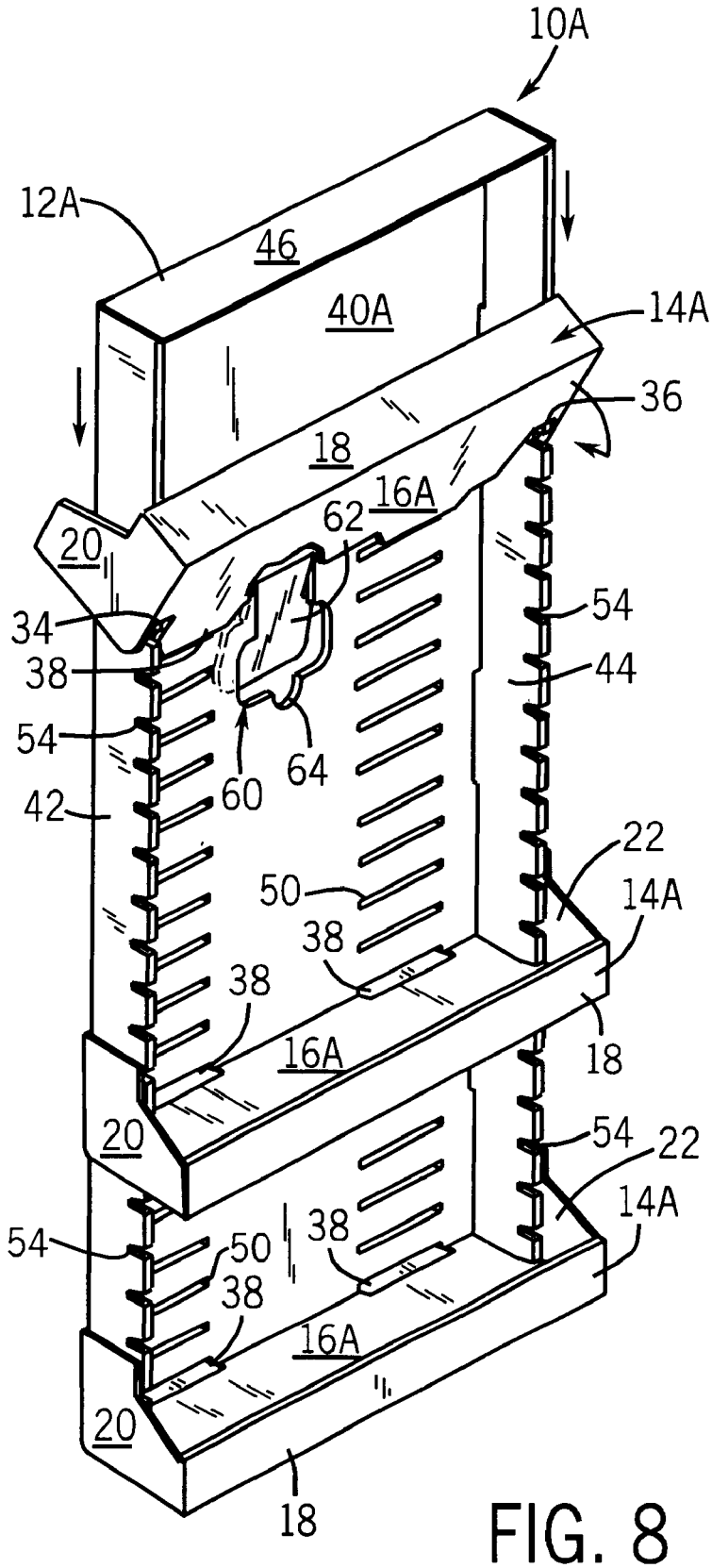
FIG. 8 is a front perspective view of an alternate embodiment of the adjustable shelf unit of the invention with the shelf support having two columns of lateral slots and the shelf having two tabs.

FIG. 8 shows an alternate embodiment 10A of the adjustable shelving unit of the present invention. Identical features are identified with identical reference numbers and similar, but different, elements are identified by the corresponding numeral albeit with the letter "A". As with the first embodiment, this embodiment includes a shelf support 12A for holding at least one shelf 14A, both being constructed by folding separate blanks (as described above) similar to that of FIGS. 6 and 5, respectively.

Once folded, the shelf 14A includes a three-ply bottom 16A joined to a two-ply front wall 18 spanning between taller single-ply angled side walls 20 and 22 at a front side 24. The top 28 of the side walls 20 and 22 are joined at a back side 26 by a single-ply cross-member 30. As before, the cross-member 30 does not extend to the bottom 16A, but rather is separated therefrom by a lateral opening, and the bottom 16A has transverse slots 34 and 36 at back corners adjacent the side walls 20 and 22. Unlike the first embodiment, the bottom 16A has a pair of single-ply lateral tabs 38A projecting outward from the back side 26. The lateral tabs 38 are spaced about the lateral center of each shelf 14A.

Similarly, once folded, the shelf support 12A has a single-ply back panel 40A with double-ply edge walls 42 and 44 as well as single-ply top 46 and bottom ends 48 at its perimeter. This back panel 40A has two columns of slots 50 spaced about its lateral center. As before, the slots 50 are longitudinally spaced apart and laterally aligned with notches 54 at the front edge of the edge walls 42 and 44. The notches 54 also have upwardly canted top surfaces 56. The back panel 40A of this embodiment 10A has a bell-shaped hanger opening 60 at its lateral center for hanging the shelving unit 10A. The hanger opening 60 is defined by a hinged cut-out 62 and a grip opening 64 sized to receive a person's finger for gripping the hinged cut-out 62 rearwardly, so that it can be engaged with a slot in a support (not shown) for the shelf unit, to keep the shelf unit from tipping forward.

The shelves 12A of this embodiment 10A are adjustable in the same way as described above. The use of a dual tab and slot arrangement provides this embodiment with increased integrity for supporting articles on the shelves 12A.

While there has been shown and described what are at present considered to be the preferred embodiments of the invention, it will be obvious to the those skilled in the art that various changes and modifications can be made to the described device without departing from the scope of the present invention. For example, it is within the scope of the invention to include more or less lateral tabs and slots and to vary the spacing between the slots. Moreover, the shelves may be mounted to the shelf support without a tab and slot connection, using only the notches in the edge walls. Additionally, only one of the edge walls may be notched in which case only the transverse slot in the shelf bottom that corresponds to the notched wall is shorter than the edge walls. Finally, while a preferred method of constructing the shelf and shelf support of corrugated paperboard has been described herein, it is also within the scope of the present invention to use other materials, such as plastic, and techniques, such as molding, to form these components.

Accordingly, to ascertain the full scope of the invention, reference must be had to the following claims:

What is claimed is:

1. A shelving unit, comprising:

a shelf support having parallel edge walls extending from lateral edges of a back panel to a front edge, each edge wall having a plurality of notches spaced apart along the front edge and aligned laterally with the plurality of notches in the other edge wall; and at least one shelf adjustably mounted to the shelf support and having side walls disposed outside the edge walls when the shelf is mounted thereto and joined along a bottom edge by a bottom panel having slots adjacent the side walls and extending forwardly from a back edge less than the depth of the edge walls and receiving the edge walls such that a portion of the bottom panel adjacent to a forward end of each slot fits within the laterally aligned notches in the edge walls, the side walls also joined at an upper back side by a back cross-member disposed behind the back panel when the shelf is mounted on the shelf support such that the back cross-member and the bottom panel define a lateral opening therebetween receiving the shelf support when the edge walls are disposed within the slots in the bottom panel;

wherein pulling the at least one shelf from a front side away from the shelf support and pivoting the front of the at least one shelf upwardly releases the bottom panel from the notches so that the at least one shelf may be removed from the shelf support or adjusted to a different height.

2. The shelving unit of claim 1, wherein the at least one shelf includes a plurality of shelves.

3. The shelving unit of claim 1, wherein the at least one shelf includes a front wall joined to the bottom panel and side walls at a front side.

4. The shelving unit of claim 1, wherein the at least one shelf and shelf support are each constructed by folding respective shelf and shelf support blanks.

5. The shelving unit of claim 4, wherein the blanks are 200 B-flute corrugated paperboard.

6. The shelving unit of claim 4, wherein the shelf support edge walls are folded to a double-ply and the back panel is of a single-ply.

7. The shelving unit of claim 6, wherein the shelf bottom panel is folded to a triple-ply and the back cross-member and side walls are of a single-ply.

8. The shelving unit of claim 1, wherein the shelf support back panel further includes at least one hanger opening for hanging the shelving unit.

9. The shelving unit of claim 8, wherein the hanger opening is defines a hinged cut-out.

10. The shelving unit of claim 9, wherein the self support back panel further includes a grip opening adjacent the hinged cut-out.

11. The shelving unit of claim 1, wherein the shelf support back panel includes a plurality of laterally aligned columns of slots and the at least one shelf includes a plurality of tabs laterally aligned with the columns of slots.

12. The shelving unit of claim 1, wherein the shelf support has top and bottom walls at respective top and bottom edges of the back panel, the bottom wall forming bottom surfaces of bottom-most notches in the edge walls.

13. A shelving unit, comprising:

a shelf support having parallel edge walls extending from lateral edges of a back panel to a front edge, each edge wall having a plurality of notches spaced apart along the front edge and aligned laterally with the plurality of notches in the other edge wall; and at least one shelf adjustably mounted to the shelf support and having side walls disposed outside the edge walls when the shelf is mounted thereto and joined along a bottom edge by a bottom panel having slots adjacent the side walls and extending forwardly from a back edge less than the depth of the edge walls and receiving the edge walls such that a portion of the bottom panel adjacent to a forward end of each slot fits within the laterally aligned notches in the edge walls, the side walls also joined at an upper back side by a back cross-member disposed behind the back panel when the shelf is mounted on the shelf support such that the back cross-member and the bottom panel define a lateral opening therebetween receiving the shelf support when the edge walls are disposed within the slots in the bottom panel;

wherein pulling the at least one shelf from a front side away from the shelf support and pivoting the front of the at least one shelf upwardly releases the bottom panel from the notches so that the at least one shelf may be removed from the shelf support or adjusted to a different height;

wherein the back panel includes a column of slots longitudinally spaced apart and laterally aligned with the notches in the edge walls and wherein the at least one shelf includes a tab projecting back from the back edge of the bottom panel sized to fit within the slots of the shelf support.

14. A shelving unit, comprising:

a shelf support having parallel edge walls extending from lateral edges of a back panel to a front edge, each edge wall having a plurality of notches spaced apart along the front edge and aligned laterally with the plurality of notches in the other edge wall; and at least one shelf adjustably mounted to the shelf support and having side walls disposed outside the edge walls when the shelf is mounted thereto and joined along a bottom edge by a bottom panel having slots adjacent the side walls and extending forwardly from a back edge less than the depth of the edge walls and receiving the edge walls such that a portion of the bottom panel adjacent to a forward end of each slot fits within the laterally aligned notches in the edge walls, the side walls also joined at an upper back side by a back cross-member disposed behind the back panel when the shelf is mounted on the shelf support such that the back cross-member and the bottom panel define a lateral opening therebetween receiving the shelf support when the edge walls are disposed within the slots in the bottom panel;

wherein pulling the at least one shelf from a front side away from the shelf support and pivoting the front of the at least one shelf upwardly releases the bottom panel from the notches so that the at least one shelf may be removed from the shelf support or adjusted to a different height;

wherein the shelf support edge wall notches have upwardly sloped top surfaces.

15. A shelving unit, comprising:

a shelf support having parallel edge walls extending from lateral edges of a back panel having a column of lateral slots therethrough spaced apart from each other; and at least one shelf adjustably mounted to the shelf support and having side walls disposed outside the shelf support edge walls when the shelf is mounted thereto and joined along a bottom edge by a bottom panel having transverse slots extending forwardly from a back edge adjacent the side walls and receiving the edge walls, the bottom panel having a lateral tab projecting back from the back edge and sized to fit within the lateral slots of the shelf support, the side walls also joined at an upper back side by a back cross-member disposed behind the back panel when the shelf is mounted on the shelf support such that the back cross-member and the bottom panel define a lateral opening therebetween receiving the shelf support when the edge walls are disposed within the transverse slots in the bottom panel;

wherein the shelf can be removed from the shelf support or adjusted to a different height when the lateral tab is disengaged from the lateral slot in the shelf support.

16. The shelving unit of claim 15, wherein at least one edge wall has a front edge with a plurality of notches spaced apart from each other and laterally aligned with the column of lateral slots in the back panel of the shelf support, and wherein at least one transverse slot of the shelf bottom panel corresponding to the at least one notched edge wall extends from the back edge a distance less the distance of the shelf support edge walls such that a portion of the bottom panel fits within at least one notch laterally aligned with a lateral slot in the shelf support in which the lateral tab of the at least one shelf is disposed.

* * * * *